US006707391B1

(12) United States Patent
Monroe

(10) Patent No.: US 6,707,391 B1
(45) Date of Patent: Mar. 16, 2004

(54) SUPPLEMENTAL AUTOMOTIVE TRAFFIC SAFETY APPARATUS AND METHOD

(76) Inventor: Louis R. Monroe, 319 N. Cherry St., Valentine, NE (US) 69201

( * ) Notice: Subject to any disclaimer, the term of this patent is extended or adjusted under 35 U.S.C. 154(b) by 0 days.

(21) Appl. No.: 09/671,033

(22) Filed: Sep. 27, 2000

(51) Int. Cl.[7] ..... G08G 1/00

(52) U.S. Cl. ..... 340/901; 340/902; 340/903; 340/905; 340/906; 340/907; 340/917; 701/117; 701/119; 701/35

(58) Field of Search ..... 340/901, 907, 340/902, 903, 906, 905, 917; 701/117, 119, 35

(56) References Cited

U.S. PATENT DOCUMENTS

| | | | | | |
|---|---|---|---|---|---|
| 3,634,866 | A | * | 1/1972 | Meyer | 340/32 |
| 3,787,845 | A | | 1/1974 | Kubota et al. | 343/7 ED |
| 3,891,966 | A | | 6/1975 | Sztanskay | 340/53 |
| 4,908,615 | A | * | 3/1990 | Bayraktatoglu | 340/917 |
| 4,996,716 | A | | 2/1991 | Potter et al. | 455/41 |
| 5,014,052 | A | * | 5/1991 | Obeck | 340/906 |
| 5,235,316 | A | | 8/1993 | Qualizza | 340/436 |
| 5,339,075 | A | | 8/1994 | Abst et al. | 340/903 |
| 5,347,273 | A | | 9/1994 | Katiraie | 340/903 |
| 5,471,214 | A | | 11/1995 | Faibish et al. | 342/70 |
| 5,493,291 | A | * | 2/1996 | Bruggemann | 340/905 |
| 5,611,406 | A | | 3/1997 | Matsuzaki et al. | 180/167 |
| 5,627,510 | A | | 5/1997 | Yuan | 340/435 |
| 5,819,198 | A | * | 10/1998 | Peterz | 701/117 |
| 5,841,367 | A | | 11/1998 | Giovanni | 340/903 |
| 5,847,661 | A | * | 12/1998 | Ricci | 340/902 |
| 5,889,475 | A | * | 3/1999 | Klosinski et al. | 340/902 |
| 6,008,740 | A | * | 12/1999 | Hopkins | 340/905 |
| 6,016,458 | A | * | 1/2000 | Robinson et al. | 701/93 |
| 6,064,319 | A | * | 5/2000 | Matta | 340/917 |
| 6,246,948 | B1 | * | 6/2001 | Thakker | 701/93 |
| 6,426,706 | B1 | * | 7/2002 | King | 340/903 |

* cited by examiner

*Primary Examiner*—Daniel J. Wu
*Assistant Examiner*—Tai T. Nguyen
(74) *Attorney, Agent, or Firm*—McKee, Voorhees & Sease, P.L.C.

(57) ABSTRACT

An apparatus and method for supplementing automotive safety includes a transmitter associated with the traffic safety concerns or conditions such as traffic signals, traffic barricades, or pedestrians. The transmitter is adapted to transmit a signal conveying information indicative of a type or class of traffic safety concern or condition. A receiver is adapted to receive and distinguish the type or class of traffic safety concern or condition. Some type of alarm or display can be connected to the receiver to convey information about the traffic safety concern or condition to a driver. The apparatus and method could also be applied to search and/or rescue missions for persons, animals or objects.

35 Claims, 6 Drawing Sheets

SUPPLEMENTAL AUTOMOTIVE TRAFFIC SAFETY APPARATUS AND METHOD

BACKGROUND OF THE INVENTION

1. Field of the Invention

The present invention relates to automotive safety, and in particular, to an apparatus useful for identifying potential traffic safety risks, concerns, or conditions.

2. Problems in the Art

The perceived benefits to modern society have resulted in the ubiquitous use of automobiles. Despite the benefits of such mobility, many traffic accidents occur. Damage includes property damage and human casualties and injuries.

Many attempts have been made to increase safety and reduce risk relative to automobile travel. Some attempts focus on making it easier to drive automobiles. Other attempts add engineering features to the automobile to help the operator react to danger.

Still further attempts focus on providing indicators or signals to drivers with respect to traffic conditions. A primary example is highway signs and traffic intersection signals. Coupled with laws and regulations, these devices help the driver understand or be aware of traffic conditions and cue the driver as to actions that should be taken, or may have to be taken.

More sophisticated systems look towards more active assistance to the driver. Some semi-automatic or autonomous driving control systems take driver responsibility away from the driver and utilize computerized systems to control operation of the vehicle and avoid danger or conflicts with other vehicles, objects, or persons. However, these latter systems are extremely complicated and expensive and are, therefore, presently cost prohibitive for widespread use.

Examples of specific attempts in this field of art are described below.

U.S. Pat. No. 5,471,214 to Faibish et al., is entitled "Collision Avoidance and Warning System". It uses radar and electro-optical signals to try to track multiple objects and warn the driver to avoid collisions. The system works even in poor weather.

U.S. Pat. No. 3,891,966 to Szatankay, is entitled "Automobile Collision Avoidance Laser System". It uses laser transmission and receiving devices from the front and rear of automobiles. It attempts to warn a driver of proximity of vehicles transmitting the signals.

U.S. Pat. No. 5,627,510 to Yuan is entitled "Vehicle Safety Distance Alarm System". Its focus is to measure the distance between two vehicles and activate an alarm when a predetermined distance for a given speed is met.

U.S. Pat. No. 4,996,716 to Potter et al. entitled "Vehicle Communication System Using Existing Roadway Loops" discloses a relatively complex communication system between a moving vehicle and a fixed location system location. Information can be exchanged between the station and the vehicle.

While these types of systems address some of the issues in the art, there is still room for improvement. There is a need in the art for an economically viable assistance system to automobile drivers to increase safety and reduce risk of damage to property and persons.

It is therefore a principal object of the present invention to provide a supplemental automotive traffic safety apparatus and method which improves over or solves problems and deficiencies in the art.

Other objects, features, and advantages of the present invention include an apparatus and a method as above described which:

a. communicates a traffic safety condition or concern from at or near the traffic safety condition or concern to a driver;

b. transmits information about the traffic safety issue to a driver;

c. is flexible in adaptation to different traffic situations;

d. is economical;

e. works under a variety of conditions, including adverse environmental conditions;

f. supplements a driver's skills and awareness;

g. provides data regarding a traffic condition or concern, allowing an operator enhanced information for making decisions, including level or type of response; and h. is adaptable to numerous vehicles or traffic situations.

These and other objects, features, and advantages of the present invention will become more apparent with reference to the accompanying specification and claims.

SUMMARY OF THE INVENTION

The present invention includes an apparatus, method, and system for supplementing automotive traffic safety. The apparatus includes a transmitter associated with a traffic safety concern or condition. A wireless signal is transmitted carrying information indicative of a type or class of traffic safety concern or condition. A receiver associated with an automotive vehicle is adapted to receive said signal.

The receiver optionally can be connected to a component which generates driver perceivable information or prompts. For example, a display can provide the operator with information related to the traffic safety concern. An alarm, visual, audible, tactile, or otherwise, can alert the driver to the traffic concern.

Traffic concerns or conditions can take many forms. Examples include, but are not limited to, other vehicles, roadway structures such as bridges, curves, or medians; traffic signs and signals such as traffic lights including various conditions of the traffic lights such as green, yellow, and red conditions; persons such as crossing guards, highway construction workers, and pedestrians; and traffic barricades or zones.

The method according to the invention includes the steps of transmitting a signal, and including information identifying a class or type of traffic safety concern or condition in the signal.

The system according to the invention includes a plurality of transmitters, each associated with a traffic safety concern or condition. A receiver is associated with a moving vehicle. A detector differentiates between different classes or types of traffic conditions or concerns. One way to differentiate is to store a database that includes identifying information regarding different types of traffic conditions and concerns in the receiver.

DRAWINGS

Figure 1:
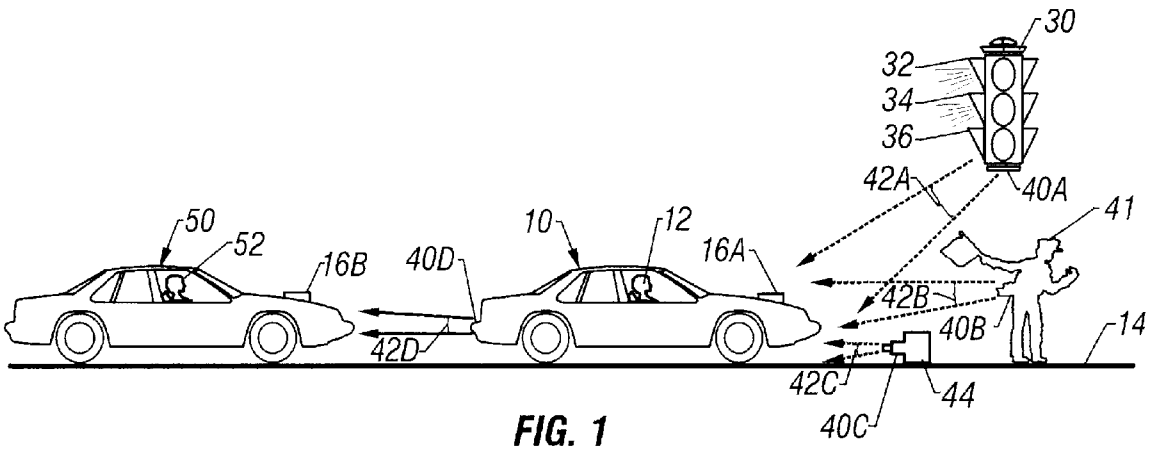
FIG. 1 is a diagrammatic view of basic components according to preferred embodiments of the present invention is association with automotive traffic situations.
Figure 2:
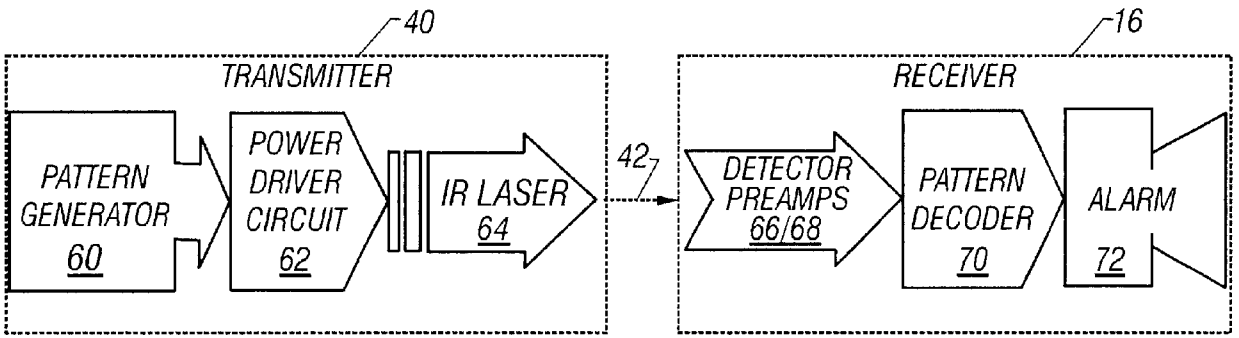
FIG. 2 is a block diagram of a preferred embodiment of the present invention.

FIGS. 4A-1, 4A-2, and 4A-3 are more detailed electrical block diagrams of the receiver shown in FIG. 2.

Figure 5:
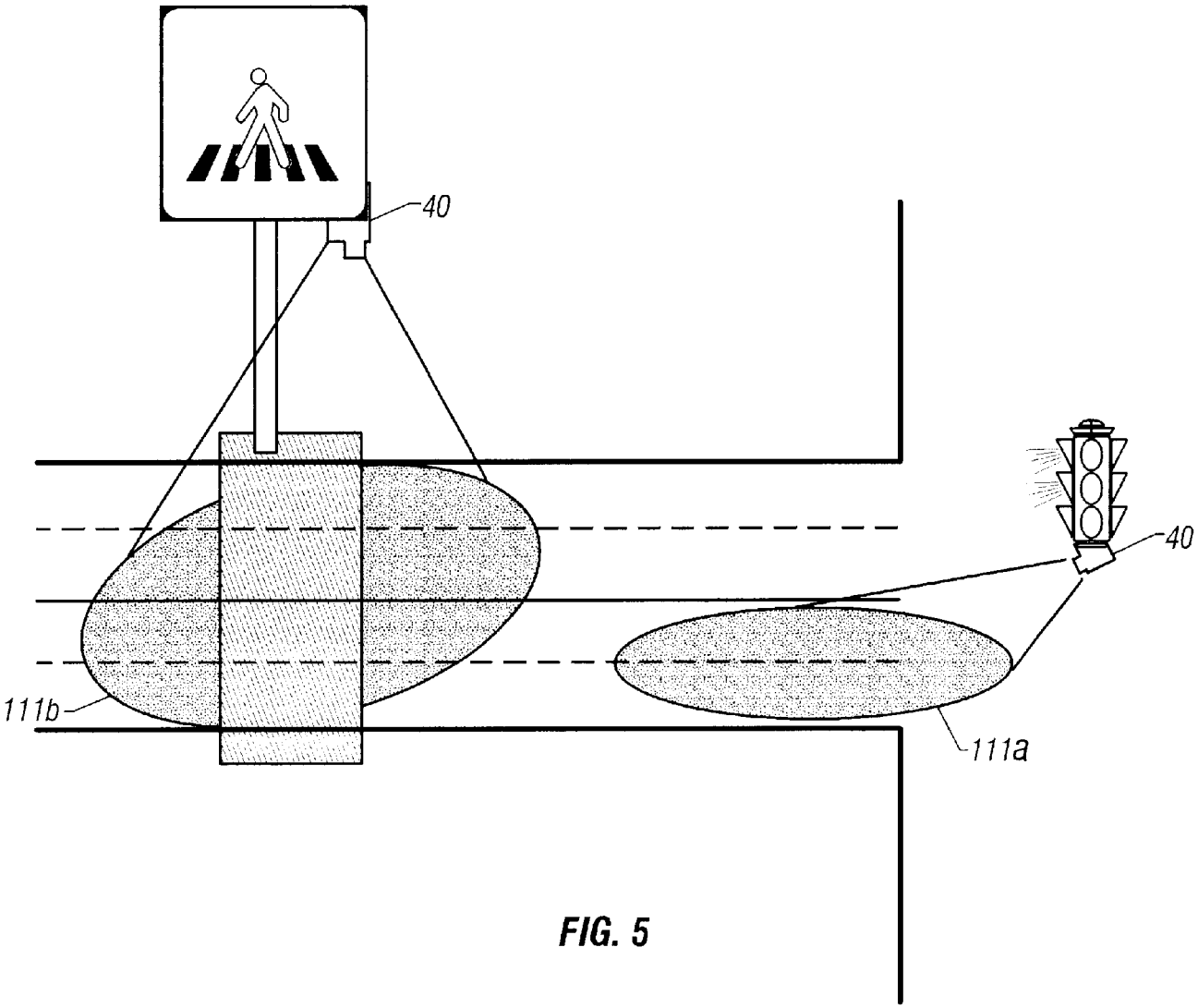

FIG. 5 is a diagrammatic depiction of optional illumination patterns for the transmitter of FIG. 2.

DETAILED DESCRIPTION OF THE PREFERRED EMBODIMENT

Overview

For a better understanding of the invention, exemplary preferred embodiments will now be described in detail. Frequent reference will be taken to the accompanying drawings. Reference numbers will be used to indicate certain parts and locations in the drawings. The same reference numerals will be used to indicate the same parts and locations throughout the drawings, unless otherwise indicated.

General Environment of Exemplary Embodiment

The following description will be made with respect to automobiles traveling on conventional automobile roadways in relation to conventional traffic safety issues. It is to be understood, however, that the invention is applicable to a wide variety of situations and conditions, both conventional and unconventional.

FIG. 1 illustrates an automobile 10 having a driver 12. Automobile 10 is traveling on a roadway 14. A receiver 16 is mounted on car 10 (e.g. at or near the front of the car).

A variety of traffic concerns or conditions are diagrammatically illustrated in FIG. 1. Many more exist. As used here, the terms traffic concern or traffic condition is intended to broadly include almost anything relevant to operation of an automotive vehicle or of interest to a driver of such a vehicle. The terms can relate to physical items such as fixtures, persons, or other vehicles. The terms can also relate to a state, a status, or a non-physical concept such as the state of a red light on a traffic light, the presence of a construction zone, or the presence of a pedestrian crossing.

In FIG. 1, traffic signal 30, of conventional nature, has three conditions: namely, red light 32; yellow light 34; or green light 36. A transmitter 40A is mounted on traffic signal 30. Another traffic condition or concern is a crossing guard 41. A transmitter 40B is carried or attached to person 41. Another possible traffic condition or concern is a traffic barricade 44 positioned on or near roadway 14. Barricade 44 includes a transmitter 40C.

Exemplary transmitters 40A–40C generate directional patterns indicated diagrammatically at 42A, 42B, and 42C, respectively, in FIG. 1. The patterns could be created by an infrared (IR) laser. Other types of signals are possible. Many types of electromagnetic radiation can be modulated to carry information. Examples are AM and FM radio. Other parts of the electromagnetic spectrum, visible or not, can be used. Information in the transmitted signal can be transferred from transmitter to receiver without hard wires or direct hardware connection.

FIG. 1 illustrates that vehicle 10 with driver 12 can include a receiver 16A that receives and processes a projected transmission from any one of transmitters 40A–40C. As will be explained later, receiver 16A would include components to derive information from the transmitted signal which can be used to assist driver 12.

FIG. 1 also illustrates a vehicle 50 with driver 52 on roadway 14. Vehicle 50 can include a receiver 16B. Receiver 16B would function like receiver 16A and receive any of signals 42A, 42B, or 42C if vehicle 50 comes within any of those beams. Moreover, vehicle 10 could include a transmitter 40D as well as receiver 16A, or a transducer could include both transmitter 40 and receiver 16. Transmitter 40 could transmit an electromagnetic signal 42, diagrammatically illustrated in FIG. 1. Another vehicle, such as vehicle 10, could receive signal 42 when it intercepts that beam and process it to assist driver 52 relative to vehicle 10 on roadway 14.

Structure

A general system block diagram is illustrated at FIG. 2. Transmitter 40 can include a pattern generator 60 (e.g. See Ref. Nos. 101–106 in FIG. 3). The object of pattern generator 60 is to provide input to power driver circuit 62 (e.g. Model TZA1015 from Phillips) for IR laser 64 (e.g. Model SLD234VL from Sony). Laser 64 can be driven to transmit a beam 42 in a pulsed manner controlled by pattern generator 60. A sequence of pulses could thus be modulated to contain information related to the device, entity, or condition to which it pertains. For example, one pulse pattern can be generated if transmitter 40 is associated with a signal light 30. A different pulse pattern can be generated if transmitter 40 is associated with a school crossing guard 42. A still further different pattern could be generated if transmitter 40 is associated with a traffic barricade 44. Likewise, a different pattern can be generated if the transmitter 40D is associated with the vehicle 10.

FIG. 2 illustrates, in block diagram form, a receiver 16. In this case, an IR laser detector 66 (Model PH502HC from NEC) is configured to respond to IR laser 64. Preamps 68 amplify any such detected signal. A pattern decoder 70 (Model 74F521 from Texas Instruments) is configured to monitor any received signals of detector 66 and check if any pattern matches a pattern stored therein. An alarm 72 (Model PKB 245PC-3601 Piezo Alarm from MuRata) is connected to pattern decoder 70. Receiver 16 can be configured to operate the alarm 72 upon detection of a recognized pattern related to a transmission from transmitter 40. The alarm can take many forms. Visual warning lights are one possibility. Audible signals are another. Tactile (e.g. vibration) signaling is a still further possibility. Combinations of the same are possible. Still further, different types or levels or intensities of the same type of alarm can be used. For example, a low level sound could initiate a warning to a driver. After a preset (fixed or variable) time period, or based on other criteria, the sound could increase in intensity.

Operation

A detailed example of the system of FIGS. 1 and 2 will now be described with regard to specific circuitry for a transmitter 40 and receiver 16.

Figure 3:
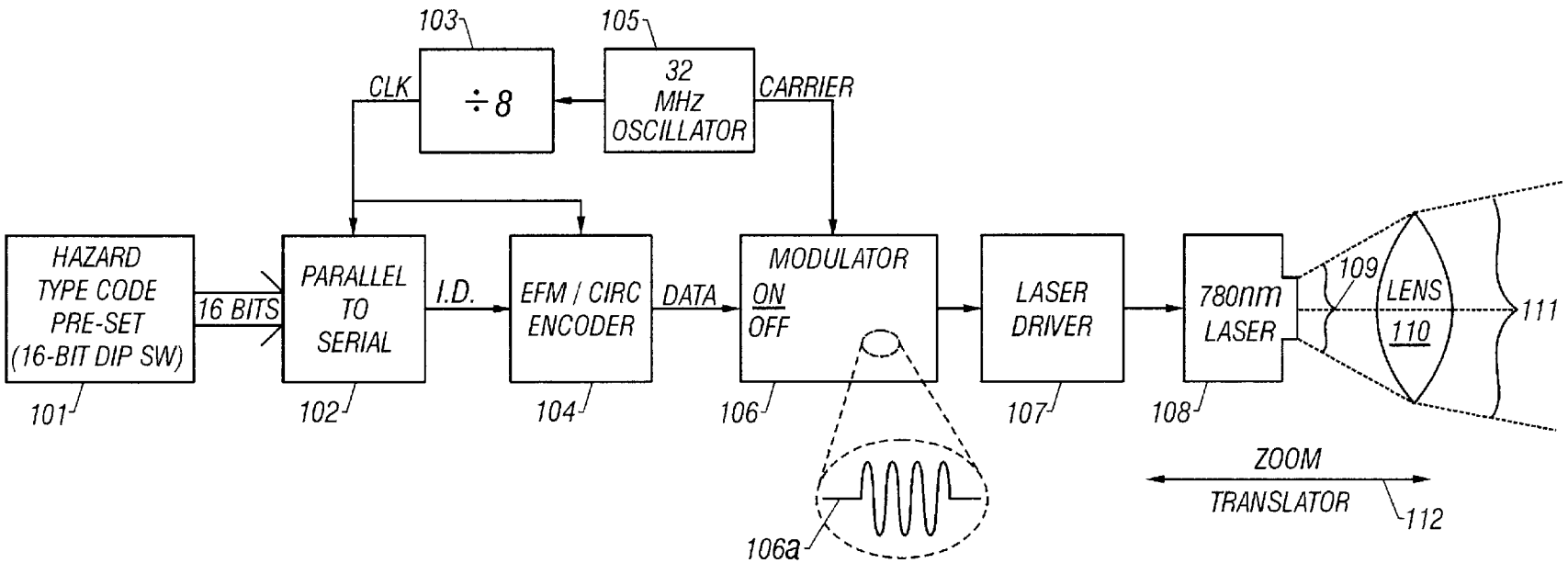
FIG. 3 is a more detailed block diagram of the transmitter shown in FIG. 2.
Figures 1, 4A:
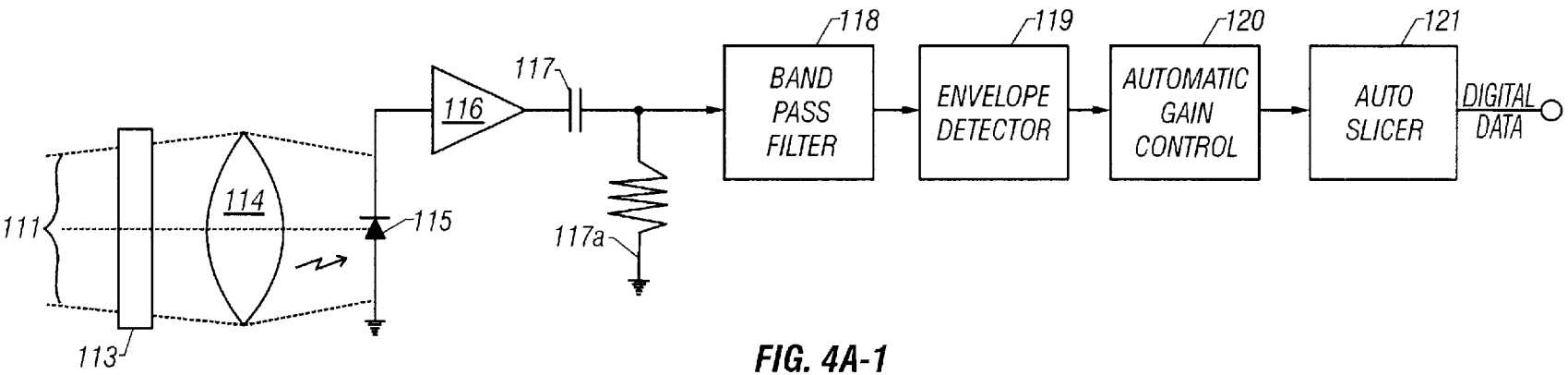
Figures 2, 4A:
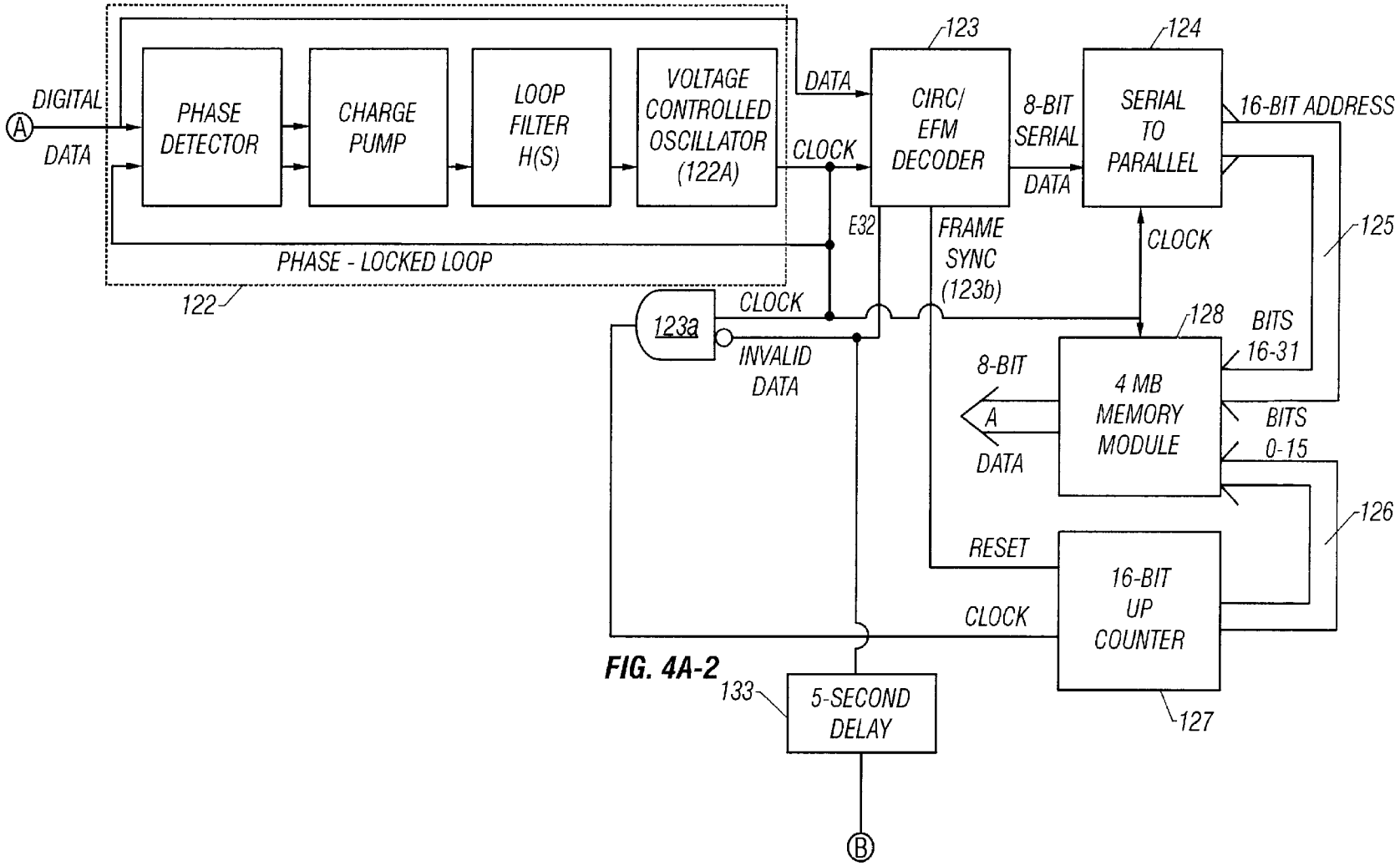
Figures 3, 4A:
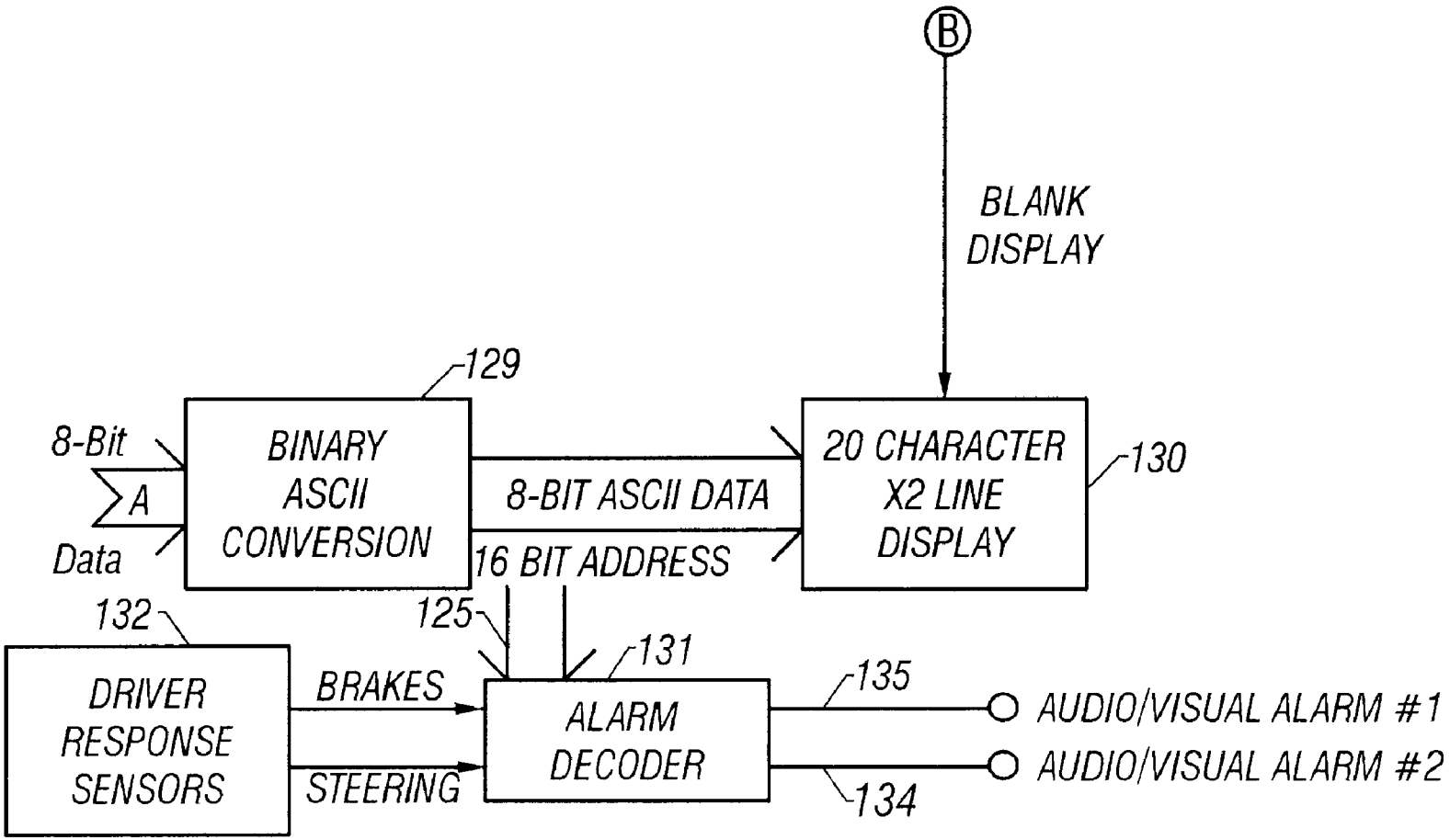

The laser illumination 111 radiated by transmitter 40 in FIG. 3 is collected by the receiver device 16 shown in FIGS. 4A-1, 4A-2/4A-3. FIG. 4A-1 details the analog signal processing by which the received IR light is converted into a digital data stream to be decoded and displayed for the vehicle operator by the digital system shown in Figures 4A-2/4A-3. The laser illumination 111 is first filtered by a narrow band optical filter 113 (e.g. Model K43-093 from Edmund Scientific band pass 770 nm to 790 nm) thereby minimizing the impact of noise otherwise caused by ambient light on a silicon photodetector 115 (Model PH502HC by NEC). Collecting lens 114 concentrates laser illumination 111 onto photodetector 115 where the light is converted into an electrical current. Transimpedence pre-amplifier 116 converts the current signal into a voltage proportional to the intensity of the laser illumination. AC-coupling capacitor 117 further eliminates the DC effect of any ambient light that falls within the pass band of optical filter 113. Bandpass noise filter 118 has a frequency response centered around the carrier frequency of oscillator 105 in order to detect the presence of the transmitted information from any other electrical noise sources such as detector noise, pre-amplifier noise, or any other radiated or conducted noise.

The modulation method discussed earlier (see 106) involves a simple interrupted carrier principle. This is a form of digital amplitude modulation (AM) wherein the presence of the carrier represents a logic 1 state and absence of the carrier signal represents a logic 0 state. Envelope detector 119 is, in essence, the detector of the presence of the carrier frequency. Since the intensity of the received laser illumination is subject to many variables, such as weather, time of day, cleanliness of the optical systems, etc., the automatic gain control block 120 is used to stabilize the amplitude of the signal to be digitized by auto slicer 121. Items 118, 119, and 120 could be implemented through a Phillips SAA7391 device. Auto slicer 121 converts the signal from an analog representation of the encoded and modulated hazard type code into a digital data stream.

The transmitter and receiver pair 40/16 communicate via the electro-optical data channel shown in FIGS. 3, 4A-1, 4A-2/4-A-3. Transmitter 40, shown in FIG. 3, includes a component to uniquely identify the hazard to which it is attached or associated, a component by which to encode the identification pattern, a component to modulate a laser diode, a laser diode by which to transmit light, and an optical system by which to shape and direct the laser light beam to a target area along the roadway (see, e.g., FIG. 5).

Hazard type code generator 101 (e.g. a dip switch loading the parallel to serial converter circuit) of transmitter 40 of FIG. 3 is preset upon installation with a 16-bit binary number comprised of an 8-bit Hazard Classification and an 8-bit Subclassification, Hazard Description Code, which uniquely identifies the hazard. For example, a traffic light is considered a "Classification", while its state, e.g. red, yellow, green, flashing red, flashing yellow, inoperative, etc. are "Description Subclassifications" or "Descriptions". Similarly, a road crossing hazard is considered a "Classification" while the type of crossing, e.g. pedestrian, bicycle, railroad, animal, etc. is therefore a "Subclassification" or "Description". There are undoubtedly hundreds of hazards to be identified in this way. In the preferred embodiment, 32,000 classifications and 32,000 subclassifications for each classification are considered sufficient to describe all hazards.

Parallel-to-serial converter 102 (e.g. Model EDE300 of E-lab) accepts the pre-set switch settings of component 101 as a 16-bit binary representation and produces a serial digital data stream in which the hazard identification is repeated continuously and indefinitely at the data rate given by oscillator 105 and clock generator 103 (divide by eight).

There are many forms of modulation encoding as well as error detection and correction schemes that could be used. Where cost is a significant consideration, the most common, readily available, inexpensive, and reliable system is that used in the compact disc industry. Therefore, Cross-Interleaved Reed-Solomon Code (or CIRC), and Eight-to-Fourteen Modulation scheme (or EFM) are chosen. The serial data stream enters EFM/CIRC encoder 104, whose output is another serial data stream comprised of clock, user data, error detection and correction, and modulation encoding.

In order to enhance the reliability of the recovered data, modulator 106 enables and disables oscillator 105 in sequence with the serial data stream. In this way, for each digital pulse, at least 24 cycles of the oscillator will ultimately be transmitted. In the preferred embodiment, a digital logic level 1 enables the oscillator output and a digital logic level 0 disables the oscillator.

A simple laser driver 107 (e.g. Model TZA1015 from Phillips) accepts the modulated carrier signal and drives current through diode laser 108 in direct proportion to the modulated carrier. If desired, the wavelength and peak output power of laser diode 108 can be chosen based on their ability to penetrate a variety of weather conditions such as fog, snow, and rain. High-powered 780 nm lasers are readily available and relatively inexpensive. Other wavelengths are, of course, possible. It is not limited to the values shown in FIG. 3.

Diode lasers produce elliptical beams with broad dispersion angles. This property is ideal for applications in which the area illuminated by the laser diode is elliptical in shape as well (See FIG. 5). A concentrating lens is adjustable by means of a zoom-type translation mechanism (diagrammatically illustrated at 110/112 and commercially available, e.g., Model K61-386 from Edmund Scientific) in order to properly align and shape the output beam 111 to cover only the desired area of the roadway.

The digital data stream produced by auto slicer 121 contains a combination of user data, error detection and correction information, and a timing signal. Phase-locked loop circuit 122 uses the logic level transition edges to synchronize a voltage-controlled oscillator 122*a* with the incoming data stream. The output signals of the phase-locked loop are the user data and the clock signal recovered from the user data.

The purposes of CIRC/EFM decoder 123 are to detect and correct any errors that occur in the input data stream, remove the redundant error-detection and correction information, and demodulate the data stream from its 14 bit symbolic form to the original 8 bit user data bytes. When the CIRC/EFM decoder is unable to properly decode the digital data steam due to high levels of noise or interference, one flag line (E32) is set to indicate "Invalid Data." This flag is used to control the clock to the up counter 127, thereby eliminating the nuisance of the display reacting to random data.

These 8-bit user data bytes are converted from a serial data stream to a parallel, 16-bit address 125 by serial-to-parallel converter 124. The 16-bit address provides the top 16-bits of the 32-bit address of the 4 MB memory module 128. 16-Bit Up Counter 127 provides the lower 16-bits of address on a cyclical basis, reset by the frame sync line 123*b* provided by CIRC/EFM decoder 123. In this way, each of the addresses from the upper 16 bit address can contain a 2352 character message for the display.

The binary data byte located at each address is converted to an ASCII character by Binary-to-ASCII converter 129 (e.g. Model by loading memory with ASCII values instead of binary values). Display Driver/Display 130 (e.g. Model G121CB1PC from Seiko) accepts the ASCII character code and produces a 20 character by 2-line display, readable by the vehicle operator. After invalid data has been detected for a prescribed period of time, Delay Timer 135 (e.g. Model LM555from National Semiconductor) will blank the display to eliminate false messages or alarms.

In addition to character display 130, an alarm decoder 131 (e.g. Model 74F521 from Texas Instruments) can interpret specific ASCII messages or characters to form two or more classes of alarms, depending on the hazard. For example, if the vehicle operator is about to run a yield sign or yellow traffic light, alarm decoder 131 can be programmed to sound a low level audible tone with yellow light as Audio/Visual Alarm #1 (135). If, however, the operator is about to drive through a stop sign or red light, the Alarm Decoder could be programmed to sound a loud audible tone and red indicator lamp as Audio/Visual Alarm 2 (134).

The operator's response to hazard conditions is still important. As such, certain driver response sensors 132 optionally can be engaged in or connected with controlling alarm decoder 131. For example, if the operator applies the brakes of the automobile in response to a hazard indication, then alarm decoder 131 may be disabled. Or if a steering system sensor indicates that the steering wheel is deflected significantly while display 130 indicates the presence of a construction barricade, alarm decoder could be disabled. Clearly, there are many scenarios for this type of interactivity between the hazardous conditions and driver responses. The examples given herein are provided as a means of demonstrating the interactivity of this invention and not be way of limitations.

Each hazard code transmitter 40 can be used to communicate the presence of a dangerous situation to the operator of an approaching vehicle 10. The type and severity of the hazard can be given by the Hazard Type Code, defined herein.

The Hazard Type Code can consist of a 16 bit digital word comprised of two 8-bit bytes. Other bit and byte lengths, of course, are possible. The higher order byte gives the Hazard Classification while the lower order byte gives the Hazard Description. Examples of some typical Hazard Classifications and Descriptions are given below:

0000xxxx: Traffic Light

0000: Continuous Red

0001: Continuous Yellow

0010: "Mature" Yellow

0011: Flashing Red

0100: Flashing Yellow

0101: Out of Order

0001xxxx: Road Sign

0000: Stop Sign

0001: Yield Sign

0010: Merge Left

0011: Merge Right

0100: Speed Bump Ahead

0101: Children at Play

0010xxxx: Low Overpass xxxx: Height code in 0.5 ft increments>than 8 feet

0011xxxx: 4-way stop status

0000: Person to left goes next

0001: Person to right goes next

0010: Person straight ahead goes next

0011: My turn

0100xxxx: Road Condition

0000: Dry

0001: Wet

0010: Icy

0011: Snow covered

0100: Loose gravel

0101xxxx: Crossing Hazard

0000: Pedestrian Crossing

0001: Animal Crossing

0010: Railroad Crossing

0011: Bicycle Crossing

These examples are intended to suggest some of the many possible uses for this interactive traffic safety device and method. This preferred embodiment is not limited to the examples given above.

It can therefore be seen that transmitter 40 is configurable to transmit a variety of different modulated signals. Signals can identify different classes or types of traffic related conditions or concerns such as traffic signals, special highway areas such as crosswalks, constructions zones or barriers, etc. It can also be used to identify persons such as crossing guards, policemen, or pedestrians, or construction workers. Receiver 16 is configurable to recognize and differentiate between various information transmitted from transmitter 40 and characterize the type of traffic concern or condition to the driver of a vehicle using receiver 16. The driver is therefore prompted not only that there is a traffic concern or condition, but provides the driver with information and intelligence about the type of condition or concern to allow the driver to better react to the concern or condition than if either left to the driver's own senses and awareness or simply notified there is some type of (but not further characterized) traffic concern or condition ahead.

Options and Alternatives

The included preferred embodiment is given by way of example only and not by way of limitation to the invention, which is solely described by the claims herein. Variations obvious to one skilled in the art will be included within the invention defined by the claims. For example, IR laser is not the only transmission medium that could be used. A number of electromagnetic radiation types could be used. Examples are AM or FM radio. Further examples are possible.

Furthermore, the system could be integrated with one or more transducers or other components in a receiver's vehicle. Such transducers could sense conditions such as application of the vehicle brake or abrupt change in steering direction. The transduced information could be programmed into the receiver as indicative that the driver is already aware of the traffic condition or concern and has taken an action indicative of such awareness. In such cases the programming, if desired, could reset the system or disable any alarm because it is not needed.

A still further example would be integration of components that could measure distance and/or speed between the receiver vehicle and a transmitter, either stationary or moving. By basic principles, most electromagnetic spectrum transmissions can be used to calculate distance and speed by means and techniques well known in the art. Such information could be used, for example, by the present system in the following way. An increasingly urgent or higher intensity or different alarm could be presented to the driver depending on how far away from the traffic concern or condition, or how fast it is approaching. Other functions are possible. For example, as described above, the system could contain a display that simply tells the driver how far and at what speed the traffic condition or concern is approaching.

Another optional feature could be integration of a proximity sensor and warning. Receiver 16 could sense a traffic concern or condition when it detects a beam 42. An example could be a loading dock having a transmitter 40. A proximity sensor, such as used many times with automatic garage door openers could include a photo optical beam generated by a different transmitter that projects a very focused beam to a corresponding receiver spaced apart a distance (e.g. on opposite sides of the loading dock). Once the vehicle driver is notified by a receiver 16 that it is within the transmission pattern of a transmitter 40 relative to a loading dock (thus notifying the driver of the correct loading dock), the driver could back up the vehicle towards the correct loading dock. The photo optical beam of the proximity sensor would be positioned so that when the vehicle is backed up to the correct position (e.g. adjacent the loading dock), the vehicle interrupts the photo optical beam. Some sort a signal can be given to the driver the correct position has been reached, indirectly or through receiver 16.

The system potentially could be used for functions other than those more closely associated with traffic safety hazards or concerns. An example is as above, the loading docks situation. Other data or information can be displayed to the driver.

Another example would be search and rescue situations. A transmitter could be worn by a person (e.g. soldier). It could assist in a search for the person. The transmission could help in identifying the person (having a unique identifying code) and location of the person. A transmitter could be placed on an animal (e.g. pet) and assist in identifying and locating the animal. Still further, a transmitter placed in a vehicle could send out the VIN of the vehicle if stolen. A receiver could differentiate transmissions and listen for only those VIN's of vehicles reported stolen. The transmitter could be activated remotely or by some event (e.g. on-authorized entry or ignition).

What is claimed is:

1. An apparatus for supplementing automotive traffic safety comprising:

a transmitter associated with a traffic concern or condition external of the vehicle adapted to transmit a wireless directional signal including a code representative of a particular type or class of traffic concern or condition, the transmitter adapted to produce a non-omnidirectional beam of controlled direction, power, and shape to a generaly confined target area, a pattern generator to produce a pattern correlated to said code; and a modulator to modulate the pattern into the beam;

a receiver associated with an automotive vehicle adapted to store a plurality of different codes, including codes relating to different types or classes of traffic concerns or conditions, adapted to receive said signal when in the target area, and including an indicator perceivable by a human, the receiver comprising a collector for collecting energy from the beam when oriented toward the beam, an automatic gain control and amplifier adapted to amplify the collected energy, a pattern decoder including a demodulator for separating the pattern from the beam, a memory to store a plurality of codes correlated to different patterns and a comparator to compare the pattern for any match with a stored code in memory;

so that when the signal is received by the receiver, if a code is recognized in the signal, the receiver causes the indicator to provide a human perceivable indication of a type or class of traffic concern or condition.

2. The apparatus of claim 1 wherein the transmitter and receiver transmit and receive electromagnetic energy.

3. The apparatus of claim 2 wherein the electromagnetic radiation is non-visible laser radiation.

4. The apparatus of claim 3 wherein the laser radiation is modulated.

5. The apparatus of claim 3 wherein the laser radiation is pulsed.

6. The apparatus of claim 1 wherein the traffic safety concern or condition comprises an item related to automotive traffic on or near a roadway.

7. The apparatus of claim 6 wherein the item is a fixed item.

8. The apparatus of claim 7 wherein the fixed item is taken from the set comprising a traffic barricade, a traffic crossing, a traffic signal, and a roadway fixture.

9. The apparatus of claim 6 wherein the item is a nonfixed item.

10. The apparatus of claim 9 wherein the nonfixed item is taken from the set comprising an automotive vehicle and a person.

11. The apparatus of claim 10 wherein the person comprises a person taken from the set comprising a crossing guard, a policeman, pedestrian, a construction worker.

12. The apparatus of claim 1 further comprising mounting brackets adapted for internal or external mounting of a transmitter.

13. The apparatus of claim 1 wherein the pattern modulated into the transmitted signal comprises a class of traffic hazard.

14. The apparatus of claim 1 wherein the concern or condition is taken from the set comprising traffic barricades, an other automotive vehicle, a roadway curve, a roadway sign, a pedestrian crossing.

15. The apparatus of claim 14 further comprising a code for each type of concern or condition.

16. The apparatus of claim 15 further comprising a database for said codes.

17. The apparatus of claim 1 further comprising a component to focus the signal directionally.

18. The apparatus of claim 1 wherein said receiver further comprises an indicator perceivable by a human.

19. The apparatus of claim 18 wherein the indicator is taken from the set comprising visual display, audible indicator, tactile indicator, or any combination thereof.

20. The apparatus of claim 19 wherein the visual display is adapted to display data.

21. The apparatus of claim 1 further comprising multiple transmitters associated with multiple traffic safety concerns or conditions.

22. The apparatus of claim 21 wherein transmitters associated with traffic safety concerns or conditions of the same type or class transmit the same signal.

23. The apparatus of claim 21 wherein transmitters associated with traffic safety concerns or conditions of different classes transmit different signals.

24. The apparatus of claim 1 further comprising multiple receivers on multiple vehicles.

25. A system for supplementing automotive traffic safety comprising:

a plurality of transmitters each associated with at least one traffic, safety concern or condition, each transmitter adapted to generate a directional signal including a code indicative of a traffic safety concern or condition, the transmitter adapted to produce a non-omnidirectional beam of controlled direction, power, and shape to a generally confined target area, a pattern generator to produce a pattern correlated to said code; and a modulator to modulate the pattern into the beam;

a receiver associated with an automotive vehicle adapted to receive said directional signal when in the target area, each receiver comprising a collector for collecting energy from the beam when oriented toward the beam, an automatic gain control and amplifier adapted to amplify the collected energy, a pattern decoder including a demodulator for separating the pattern from the beam, a memory to store a plurality of codes correlated to different patterns and a comparator to compare the pattern for any match with a stored code in memory;

a database of a plurality of codes related to different types or classes of traffic safety concerns or conditions in the receiver, the database having identifying information regarding each class or type of automotive safety concern or condition;

a user perceivable indicator adapted to trigger when thee receiver recognizes a code and produce an indication of the type or class of traffic concern or condition.

26. The system of claim 25 wherein each transmitter transmits electromagnetic radiation including identifying information regarding a traffic safety concern or condition.

27. The system of claim 25 wherein traffic concerns include, but arm not limited to, traffic barricades, other vehicles, or persons.

28. The system of claim 25 wherein the identifying information is distinguishable for each class or type of traffic safety concern or condition.

29. The system of claim 25 wherein said identifying information is distinguishable for each traffic safety concern or condition.

30. An apparatus for assistance in identifying and locating a class of object comprising:

a transmitter associated with an object adapted to transmit a directional wireless signal including a code representative of a particular type or class of traffic concern or condition, the transmitter adapted to produce a non-omnidirectional beam of controlled direction, power, and share to a generally confined target area, a pattern generator to produce a pattern correlated to said code, and a modulator to modulate the pattern into the beam;

a receiver adapted to store a plurality of different codes, including codes relating to different types or classes of traffic concerns or conditions, adapted to receive said signal when in the target area, the receiver comprising a collector for collecting energy from the beam when oriented toward the beam, an automatic gain control and amplifier adapted to amplify the collected energy, a pattern decoder including a demodulator for separating the pattern from the beam, a memory to store a plurality of codes correlated to different patterns and a comparator to compare the pattern for any match with a stored code in memory and including an indicator perceivable by a human so that when the signal is received by the receiver, if a code is recognized in the signal, the receiver causes the indicator to provide a human perceivable indication of a type or class of traffic concern or condition.

31. The apparatus of claim 30 wherein the class of object is a person.

32. The apparatus of claim 30 wherein the class of object is an animal.

33. The apparatus of claim 30 wherein the class of object is a motor vehicle and the transmitter transmits a vehicle identification number.

34. An apparatus for supplementing automotive traffic safety comprising:

a transmitter adapted to transmit a wireless directional signal and for placement and operation from the location of a traffic concern or condition external of the vehicle, the signal including a code representative of a particular type or class of traffic concern or condition, the transmitter adapted to produce a non-omnidirectional beam of controlled direction, power, and shape to a generally confined target area, a pattern generator to produce a pattern correlated to said code; and a modulator to modulate the pattern into the beam;

a receiver associated with an automotive vehicle adapted to store a plurality of different codes including codes relating to different types or classes of traffic concerns or conditions, adapted to receive said signal when in the target area, the receiver comprising a collector for collecting energy from the beam when oriented toward the beam, an automatic gain control and amplifier adapted to amplify the collected energy, a pattern decoder including a demodulator for separating the pattern from the beam, a memory to store a plurality of codes correlated to different patterns and a comparator to compare the pattern for an match with a stored code in memory and including an indicator adapted to issue an alarm perceivable by a human and indicative of a type or class of traffic concern or condition upon receipt of a signal from the transmitter if a code is recognized in the signal.

35. A system for supplementing automotive traffic safety according to claim 34 comprising:

a plurality of said transmitters each associated with at least one traffic safety concern or condition, each transmitter adapted to generate a directional signal including information indicative of a class or type of traffic safety concern or condition from a plurality of classes or types of traffic safety concerns or conditions;

a component in the receiver adapted to differentiate between the plurality of classes or types of traffic safety concerns or conditions.

* * * * *

UNITED STATES PATENT AND TRADEMARK OFFICE

CERTIFICATE OF CORRECTION

PATENT NO. : 6,707,391 B1
DATED : March 16, 2004
INVENTOR(S) : Monroe, Louis R.

It is certified that error appears in the above-identified patent and that said Letters Patent is hereby corrected as shown below:

Column 11,
Line 23, should read -- and shape to a generally confined target area, a pattern --

Column 12,
Line 28, should read -- to compare the parttern for any match with a stored code --

Signed and Sealed this

Seventh Day of September, 2004

JON W. DUDAS
*Director of the United States Patent and Trademark Office*